US008196247B2

(12) United States Patent
Fellhauer et al.

(10) Patent No.: US 8,196,247 B2
(45) Date of Patent: Jun. 12, 2012

(54) FLOOR MAINTENANCE APPARATUS AND METHOD OF USE

(75) Inventors: Jeffery R. Fellhauer, Toledo, OH (US); William E. Brashear, Jr., Maumee, OH (US)

(73) Assignee: NSS Enterprises, Inc., Toledo, OH (US)

( * ) Notice: Subject to any disclaimer, the term of this patent is extended or adjusted under 35 U.S.C. 154(b) by 902 days.

(21) Appl. No.: 12/288,811

(22) Filed: Oct. 23, 2008

(65) Prior Publication Data

US 2010/0101033 A1 Apr. 29, 2010

(51) Int. Cl.
*A47L 11/00* (2006.01)
*A47L 11/40* (2006.01)

(52) U.S. Cl. ..... 15/49.1; 15/98; 280/63

(58) Field of Classification Search ..... 15/49.1, 15/50.1, 98; 280/63
See application file for complete search history.

(56) References Cited

U.S. PATENT DOCUMENTS

| | | | | |
|---|---|---|---|---|
| 4,010,507 | A | 3/1977 | Johnson | |
| 4,679,807 | A | 7/1987 | Raybon | |
| 4,709,771 | A | 12/1987 | Basham et al. | |
| 4,825,500 | A | 5/1989 | Basham et al. | |
| 5,004,251 | A | 4/1991 | Velke et al. | |
| 5,044,043 | A | 9/1991 | Basham et al. | |
| 5,651,558 | A * | 7/1997 | Boyce | 280/304.1 |
| 5,785,453 | A | 7/1998 | Marty et al. | |
| 5,947,490 | A | 9/1999 | Munnoch et al. | |
| 6,059,309 | A | 5/2000 | Munnoch et al. | |
| 6,145,855 | A | 11/2000 | Bellis, Jr. | |
| 6,497,422 | B1 | 12/2002 | Bellis, Jr. | |
| 6,874,796 | B2 | 4/2005 | Mercurio | |
| 8,091,672 | B2 * | 1/2012 | Gutsch et al. | 180/218 |
| 2009/0038105 | A1 | 2/2009 | Mayer | |

FOREIGN PATENT DOCUMENTS

WO WO 2005/117677 12/2005

OTHER PUBLICATIONS

Unknown, Castle Rock Industries Wins the ISSA Innovation Award for the Windsor Chariot, unknown, unknown, unknown, unknown, unknown, unknown.

* cited by examiner

*Primary Examiner* — Randall Chin
(74) *Attorney, Agent, or Firm* — Marshall & Melhorn LLC

(57) ABSTRACT

A floor maintenance apparatus having a floor maintenance machine and an attached sulky which allows an operator to ride in a standing position or walk behind the floor maintenance machine. A wheeled sulky having a first attaching portion, a stopping portion, a wheel receiving portion, and a platform portion having a first portion and a second portion is also provided. Methods of operating the apparatus are also provided.

14 Claims, 4 Drawing Sheets

FLOOR MAINTENANCE APPARATUS AND METHOD OF USE

BACKGROUND OF THE INVENTION

Battery and cord powered floor maintenance machines are well known in the art. Generally, battery powered floor maintenance machines are provided with at least one rotatable pad, at least one front wheel, a battery compartment, a battery pack, at least one drive motor, a driven wheel, a steering column for allowing an operator to direct the machine's movements, and two rear wheels. Cord powered floor maintenance machines generally have similar components except for the battery pack and the battery compartment.

Typically, floor maintenance machines allow the operator to steer the machine while walking behind it. This can be extremely inefficient for several reasons. First, the maximum operating speed of the machine is usually greater than that of the operator walking behind it. Also, the operator's pace will generally be reduced as the operator gets tired. Finally, the reduction in the operator's walking speed will vary greatly from operator to operator. Thus, great deviation in the time needed to complete floor maintenance will exist between different operators using the same machine. In this way operating a floor maintenance machine is unpredictable, generally inefficient, and increasingly inefficient over time. It would be desirable then to provide an apparatus and a method for maintaining floors where the time needed to complete the job was predictable and limited only by the speed of the floor maintenance machine.

Some skilled in the art have recognized this and developed floor maintenance machines that can be operated so that the operator can sit behind the machine while operating it. These inventions however greatly increase the foot print of the floor maintenance machine, which is undesirable especially when operating in small areas. Thus, an advantage of the present invention is to provide a floor maintenance apparatus comprising a floor maintenance machine and an attached sulky that allows a floor maintenance operator to operate a floor maintenance machine in a standing position.

Another advantage of the present invention is that it does not restrict the normal maneuverability of a floor maintenance machine. A further advantage of the present invention is that it actually improves the maneuverability of a floor maintenance machine when operated by an operator standing on the sulky.

In some environments the floor to be maintained may be partitioned so that there is a large area and several smaller areas. In this situation it would be desirable to allow an operator to ride behind the floor maintenance machine to care for the large area and to also allow the operator to walk behind the machine while operating in the smaller areas. However, it would be undesirable for an operator having first used the sulky to ride behind the floor maintenance machine to then have to remove the sulky in order to walk behind it. Thus, it would be desirable to provide a method and a sulky that would allow the sulky to be positioned, without removing it from the machine, so that the operator could walk behind the machine.

Therefore, another advantage of the present invention is it allows an operator to stand behind the floor maintenance machine on a sulky and also to walk behind the machine without having to remove the sulky.

BRIEF SUMMARY OF THE INVENTION

The present invention is directed toward a floor maintenance apparatus, an attachable sulky, and methods for use.

The floor maintenance apparatus comprises a floor maintenance machine and a sulky. The floor maintenance machine is provided with a swivel to connect the machine and the sulky. The swivel also allows the sulky to rotate about a vertical axis. The floor maintenance machine is also provided with a stop to limit the rotation of the sulky about the swivel's vertical axis of rotation. The sulky has a first attaching portion for connecting to the floor maintenance machine swivel. The sulky and the floor maintenance machine are connected such that a horizontal axis of rotation is created. This allows the sulky to rotate vertically for storage when walking behind the floor maintenance machine is preferred by an operator.

BRIEF DESCRIPTION OF THE SEVERAL VIEWS OF THE DRAWING

The above, as well as other advantages of the present invention, will become readily apparent to those skilled in the art from the following detailed description when considered in light of the accompanying drawings in which.

DETAILED DESCRIPTION OF THE INVENTION

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions, or other physical characteristics relating to the embodiments disclosed are not to be considered as limiting, unless the claims expressly state otherwise. Additionally, although the invention will be described in connection with a battery powered burnisher, it would be understood by one of ordinary skill in the art that the floor maintenance apparatus, sulky, and methods for use described herein have applications to other floor maintenance machines that are controlled by an operator and are propelled by motors and/or powered by battery packs.

Figure 1:
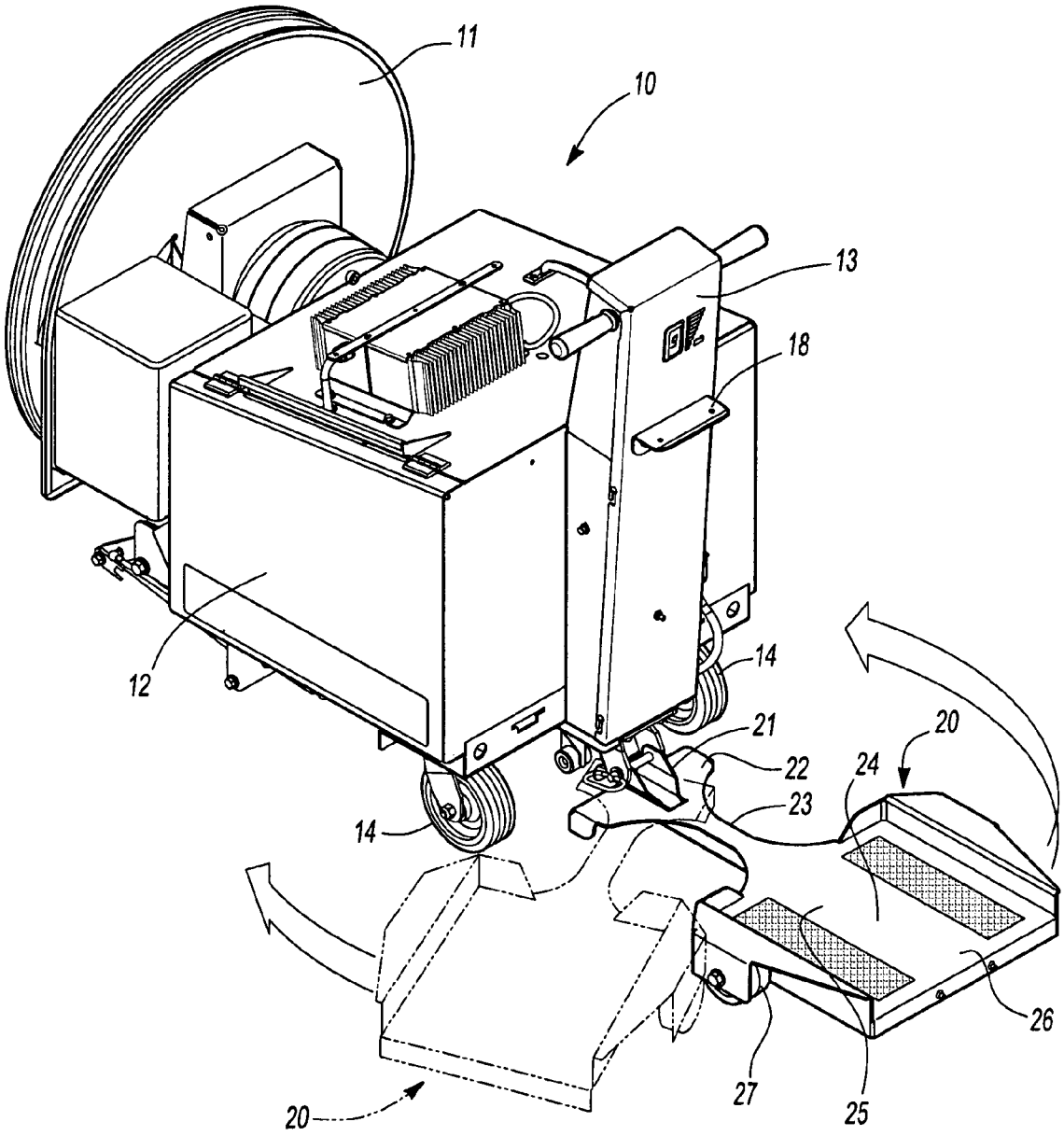
FIG. 1 is a perspective view of a floor maintenance apparatus showing a self-propelled floor maintenance machine connected to a sulky and also showing the horizontal rotation of the sulky as approximately 90° in either direction.

FIGS. 1-4 depict the floor maintenance apparatus of the present invention. FIG. 1 shows the floor maintenance machine 10 as a burnisher. The burnisher may have a rotatable pad 11, a battery compartment 12, and a battery pack (not depicted) contained in the battery compartment 12, a drive motor (not depicted) for driving a front wheel (not depicted), a steering column 13 for allowing an operator to direct the machine's movements, and two rear wheels 14. Additionally, a sulky 20 is provided. The sulky 20 preferably comprises a first attaching portion 21, a stopping portion 22, a wheel receiving portion 23, and a standing platform 24 comprising a first portion 25 and a second portion 26. The first portion 25 has at least one, and preferably two, rotatably mounted wheels 27.

Figure 2:
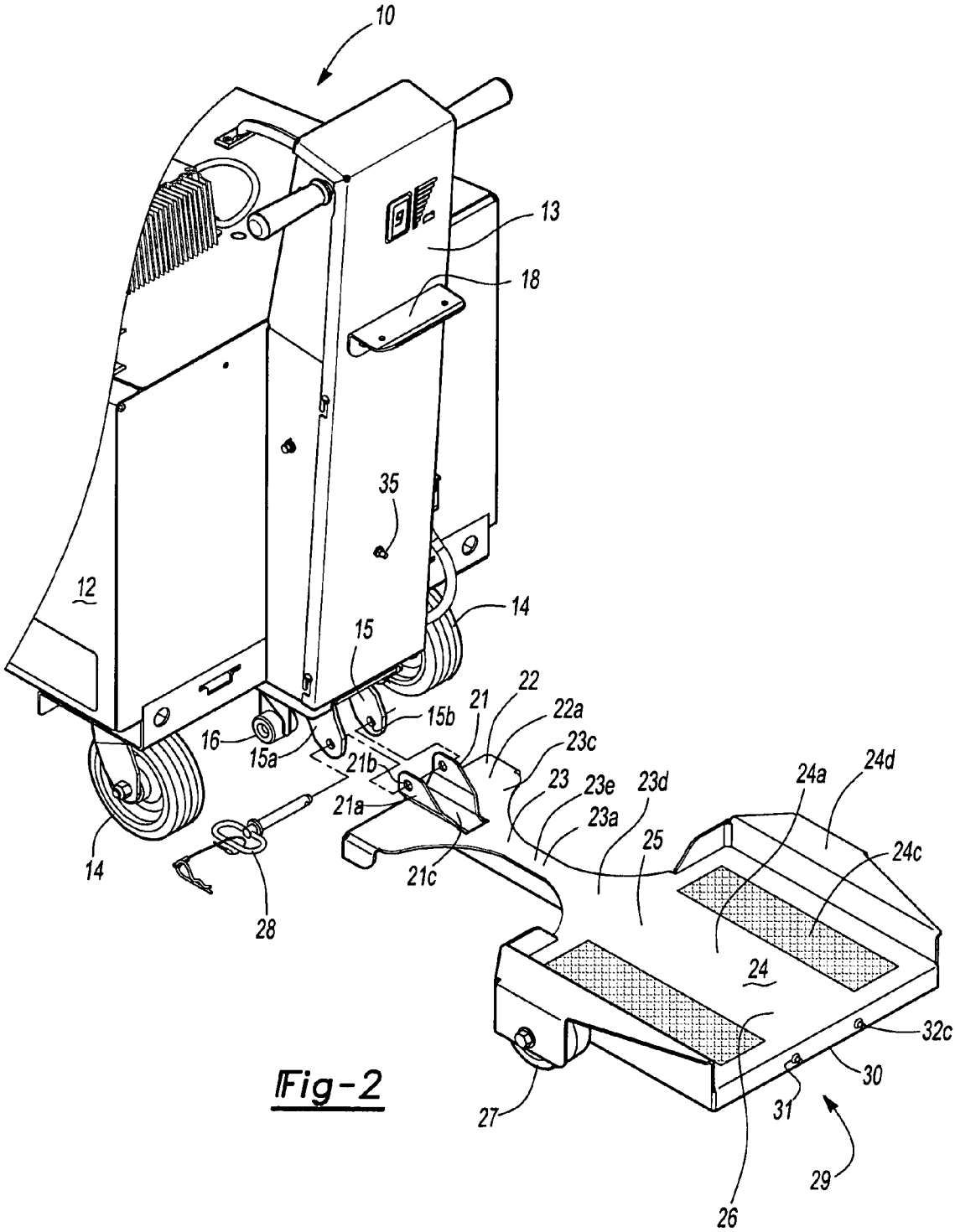
FIG. 2 is a perspective view of the floor maintenance apparatus disassembled showing the self-propelled floor maintenance machine, the sulky, and an attaching means.

FIG. 2 shows the method and means for connecting the sulky 20 to the floor maintenance machine 10. As shown, to connect the sulky 20 to the floor maintenance machine 10 an attaching means 28 is provided.

In order to provide a connection point for connecting the sulky 20 to the floor maintenance machine 10, a swivel 15 is attached to the floor maintenance machine 10. The swivel has arms 15*a* which are parallel to its vertical axis of rotation 40. Each swivel arm 15*a* has a hole 15*b* corresponding to a hole 21*b* in the first attaching portion 21 of the sulky 20. The attaching means 28 engages with the holes 15*b*, 21*b* to connect the sulky 20 to the floor maintenance machine 10.

Figure 3:
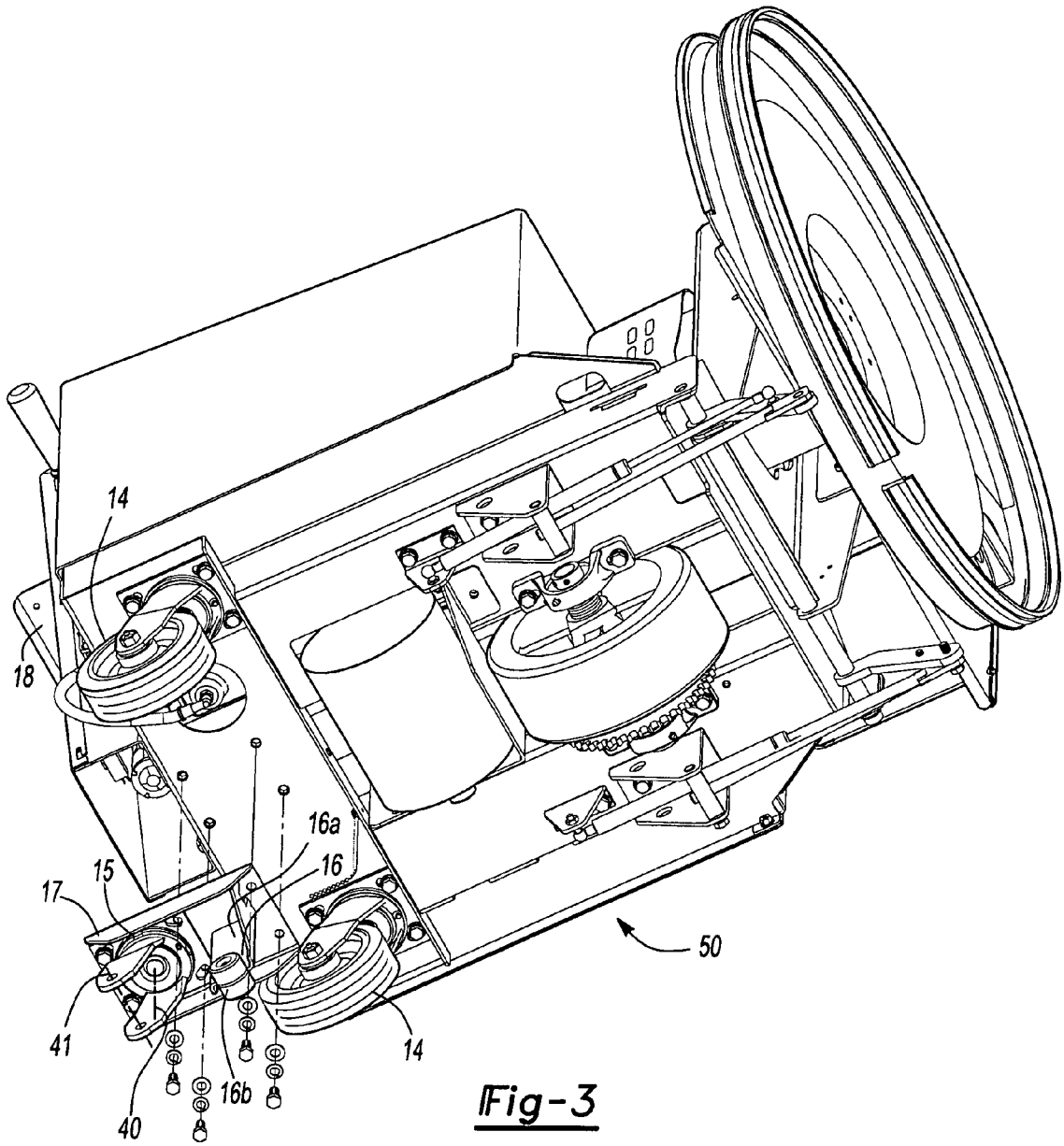
FIG. 3 is a perspective view of the floor maintenance machine showing the bottom surface of the floor maintenance machine.

Referring now to FIG. 3, the swivel 15 is preferably located on the bottom surface 50 of the floor maintenance machine 10 and at an approximately equal distance between the rear wheels 14 of the floor maintenance machine 10. The swivel 15 not only provides a connection point, but the swivel 15 also allows the sulky 20 to rotate 360° about the vertical axis 40 when the floor maintenance machine 10 turns or is driven in a reverse direction. However, it is preferable not to permit the sulky 20 to rotate 360°. Therefore, a stop 16 is provided to limit the rotation of the sulky 20.

The stop 16 is preferably located on the bottom surface 50 of the floor maintenance machine 10 and at an approximately equal distance between the floor maintenance machine's two rear wheels 14. Further, the stop 16 is positioned in-line with and forward of the swivel 15. The stop 16 and the swivel 15 are adjacent to each other so that the stop 16 can contact the stopping portion 22 of the sulky 20 to limit the rotation of the sulky 20 about the swivel's vertical axis of rotation 40. As shown in FIG. 3, both the stop 16 and the swivel 15 can be located on and attached to the floor maintenance machine 10 via a mounting bracket 17.

The stop 16 is composed of a resilient material. The stop 16 can comprise a post 16*a*. In the embodiment shown in FIG. 3, the stop 16 comprises the post 16*a* and two rubber bumpers 16*b*. As shown in FIG. 3, a rubber bumper 16*b* is fixed on each side of the post 16*a*. The bumpers 16*b* cushion the impact between the stopping portion 22 and the stop 16. The bumpers 16*b* can be made of rubber or an elastomeric material. The stop 16 can assume a variety of shapes or configurations as long as it is configured and positioned so that the wheel receiving portion 23 can receive the rear wheels 14 but the wheel receiving portion 23 is prevented from contacting the rear wheels 14.

Now referring back to the sulky 20 and FIG. 2, the first attaching portion 21 is attached to the stopping portion 22. The first attaching portion 21 is connected to the floor maintenance machine 10 by the removable attaching means 28. As shown in FIG. 2, the attaching means 28 can be a cotter pin and a clevis pin. The attaching means 28 can also be nut and a bolt, a lock weight pin, a push button lock weight pin, or any other removable attaching means which when connecting the floor maintenance machine 10 with the sulky 20 creates a horizontal axis of rotation 41 as shown in FIG. 3. The attaching means 28 is removable. This allows it to be shared among other machines and allows the sulky 20 to be used with existing floor maintenance machines. This also allows the sulky 20 to be removed from the machine, allowing the machine to be used without the sulky 20 attached.

The first attaching portion 21 has two arms 21*a* that extend upward from a base 21*c*. Each arm 21*a* has a hole 21*b* corresponding to the holes 15*b* in the swivel arms 15*a*. When connecting the swivel 15 to the first attaching portion 21, the sulky 20 is positioned so that the swivel arms 15*a* receive the first attaching portion arms 21*a* and the swivel holes 15*b* align with the first attaching portion holes 21*b*. The attaching means 28 is then slid through the four holes connecting the swivel 15 of the floor maintenance machine 10 and the first attaching portion 21 of the sulky 20 to form a single apparatus.

Figures 4, 4A:
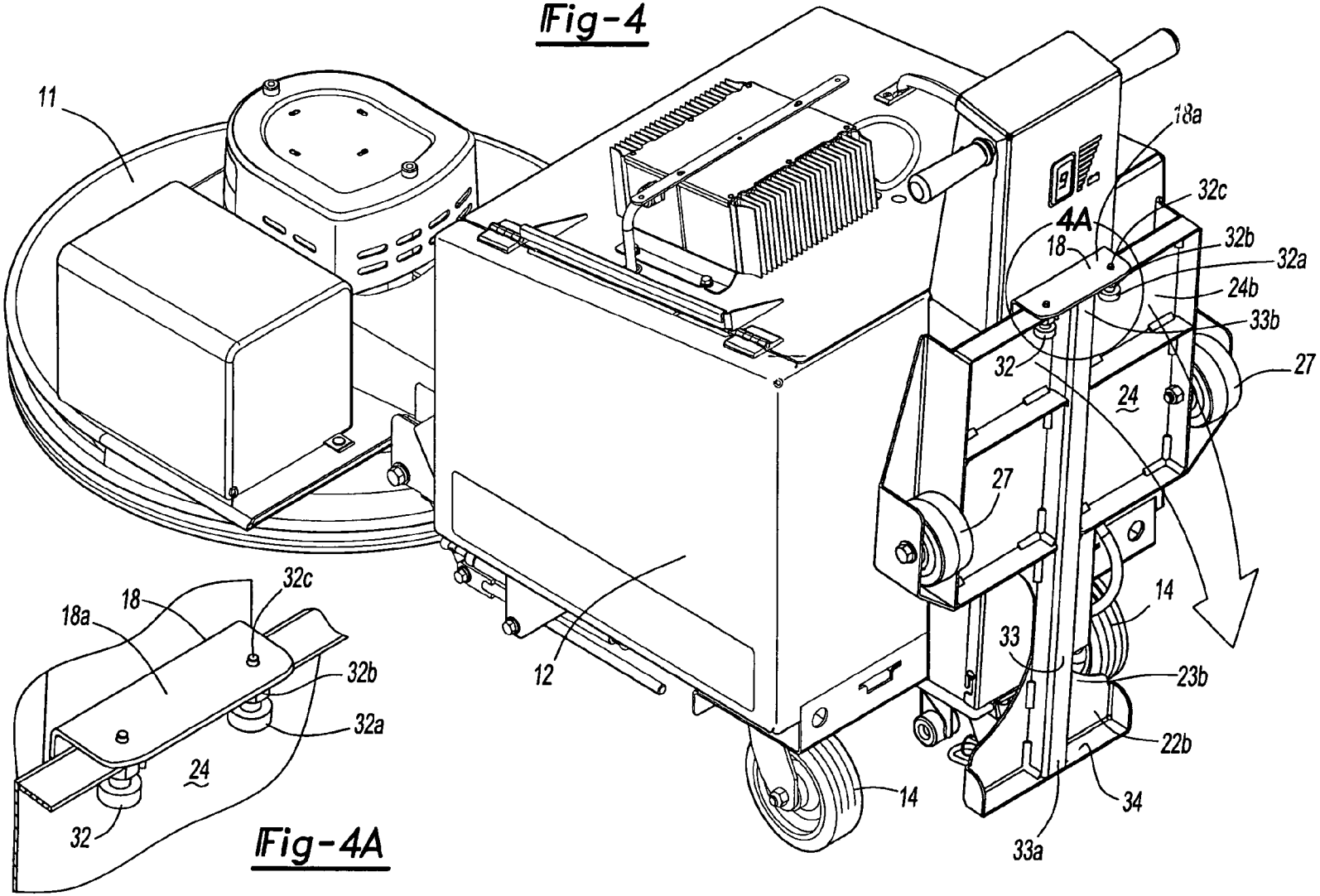
FIG. 4 is a perspective view of the floor maintenance apparatus of FIG. 1 showing the sulky rotated vertically approximately 90°.
FIG. 4A is the inset 4A of FIG. 4.

The stopping portion 22 is attached to the wheel receiving portion 23 and the first attaching portion 21. As seen in FIGS. 2 and 4, the stopping portion 22 has a first surface 22*a* where the first attaching portion 21 is attached and a second surface 22*b*. The stopping portion 22 contacts the stop 16 of the floor maintenance machine 10 to prevent excessive rotation of the sulky 20 about the vertical axis 40 of the floor maintenance machine swivel 15.

The wheel receiving portion 23 is attached at one end 23*c* to the stopping portion 22 and to the standing platform 24 at the other end 23*d*. As seen in FIGS. 2 and 4, the wheel receiving portion 23 has a first surface 23*a* and a second surface 23*b*. The wheel receiving portion 23 receives the rear wheels 14 of the floor maintenance machine 10. As shown in FIG. 2, the wheel receiving portion 23 comprises the first end 23*c*, the second end 23*d*, and a neck 23*e*. The neck 23*e* is attached to the first end 23*c* and to the second end 23*d*. Generally, the neck 23*e* has a parabolic shape on each of its sides. In the embodiment shown in FIG. 2, the neck 23*e* tapers from the first end 23*c* and from the second end 23*d* to a midpoint. However, the neck 23*e* could be shaped differently as long as the shape did not interfere with the wheel receiving portion 23 receiving the rear wheels 14 of the floor maintenance machine 10.

The standing platform 24 is attached to the wheel receiving portion 23. The standing platform 24 has a first portion 25 and a second portion 26. In the first portion 25 of the standing platform 24 at least one wheel 27 is rotatably mounted. It is preferable to rotatably mount two wheels 27 as shown in FIG. 4.

The standing platform 24 also comprises a first surface 24*a* and a second surface 24*b*. The first surface 24*a* is the surface on which the operator stands. The first surface 24*a* comprises a standing portion 24*c* and at least one guard member 24*d*. In an embodiment, like the one shown in FIGS. 2 and 4, there are two guard members 24*d* arranged so as to provide a complimentary shape with the steering column 13 of the floor maintenance machine 10. The guard members 24*d* are useful in preventing operator injury and can take many shapes but generally are raised above the first surface 24*a* of the platform 24. The guard members 24*d* are attached to the standing portion 24*c*. It is preferable that the guard members 24*d* are attached to the standing portion 24*c* at its periphery. The guard members 24*d* can be located solely in the first portion 25, but preferably they extend from the first portion 25 to the second portion 26.

It may also be preferable to provide a standing platform 24 with a non-slip first surface 24*a*. Materials capable in providing a non-slip first surface 24*a* include high skin friction plastics, non-skid tape, non-skid matting, or synthetic rubber. A non-slip surface helps to prevent operator injury when the standing platform 24 gets wet or the floor maintenance machine 10 abruptly starts or stops.

Attached to the second portion 26 of the standing platform 24 is a second attaching portion 29. The second attaching portion 29 allows the standing platform 24 of the sulky 20 to selectively connect to the steering column 13 of the floor maintenance machine 10. The second attaching portion 29 comprises a flange 30 having at least one hole 31 and at least one pull-pin 32.

As shown in FIGS. 4 and 4A, the pull-pin 32 comprises a handle 32*a*, a body 32*b*, and a shaft 32*c*. The second attaching portion flange 30 mates with a bracket 18 on the steering column 13. The steering column bracket 18 has a flange 18*a* with holes that correspond in number and diameter to the shaft 32*c* of the pull pin 32 on the second attaching portion 29. FIG. 4 shows an embodiment of the present invention wherein the second attaching portion 29 has two pull-pins 32. The pull-pin handle 32*a* and body 32*b* are located behind the second attaching portion holes 31. Unless the pull-pin handle 32*a* is pulled down, the pull-pin shaft 32*c* extends through the hole 31.

Preferably the first attaching portion 21, the stopping portion 22, the wheel receiving portion 23, and the standing platform 24 are rigidly supported by a first frame member 33. The first frame member 33 has a first end 33*a* and a second end 33*b*. The first frame member extends along and is attached to the second surfaces 22*b*, 23*b*, and 24*b* of the stopping portion 22, the wheel receiving portion 23, and the standing platform 24.

The stopping portion 22 contacts the stop 16 of the floor maintenance machine 10 which creates additional stresses on the stopping portion 22. Thus, at least one additional support for the stopping portion 22 may be advantageous. Therefore, preferably, the stopping portion 22 may be further supported by a second frame member 34 that attaches to the second surface 22*b* of the stopping portion 22 and perpendicularly to the first end 33*a* of the first frame member 33. Additional frame members can also be attached to the first frame member 33 to provide structural support to the sulky 20.

Upon connecting the floor maintenance machine swivel 15 with the first attaching portion 21 of the sulky 20 the operator can stand on the sulky 20 and ride behind the floor maintenance machine 10. Additionally, this connection is pivotal about the swivel's vertical axis of rotation 40. Thus, the sulky 20 can rotate behind the floor maintenance machine 10 as it turns or goes in reverse direction.

The sulky's rotation however is not unlimited. In fact, unlimited rotation is undesirable because the maneuverability of the floor maintenance machine 10 could be reduced. For instance, if the sulky 20 could rotate a full 360° about the swivel's vertical axis of rotation 40 and the floor maintenance machine 10 was driven in a reverse direction, the sulky 20 could jackknife or the rear wheels 14 of the floor maintenance machine 10 could contact the sulky's wheel receiving portion 23. Both results are undesirable because once either occurs driving the floor maintenance machine 10 in a reverse direction is no longer permitted until the problem is corrected. Thus, the amount of time required to complete the floor maintenance is increased.

Therefore, as shown in FIG. 1, the stop 16 is provided on the floor maintenance machine 10 to contact the stopping portion 22 of the sulky 20. The stop 16 is positioned relative to the swivel 15 so that the wheel receiving portion 23 can receive the rear wheels 14 but the wheel receiving portion 23 is prevented from contacting the rear wheels 14.

The operator stands in the standing portion 24*c* of the standing platform 24. An important feature of the standing platform 24 is the position of the wheels 27. The wheels 27 of the present invention are located in the first portion 25 of the platform 24. There they act as a fulcrum. When the operator stands on the standing portion 24*c* of the platform 24 a force is exerted by the weight of the operator which counterbalances the force exerted by the floor maintenance machine 10 on its rear wheels 14. This counterbalance upwardly biases a portion of the rearward weight of the floor maintenance machine 10 which in turn improves the overall maneuverability of the apparatus by allowing the rear wheels 14 to turn more freely.

The present invention also provides a method for allowing an operator to selectively connect the sulky 20 to the floor maintenance machine 10 at a second connecting point as shown in FIG. 4. Specifically, after connecting the sulky 20 at the first attaching portion 21 to the floor maintenance machine swivel 15, the operator can stand on the sulky 20 and ride behind the floor maintenance machine 10. In the alternative, as shown in FIG. 4, the operator may lift the sulky 20 in a vertical direction along the horizontal axis of rotation 41 provided by the attaching means 28. The operator can then selectively connect the second attaching portion 29 of the standing platform 24 to the steering column 13 of the floor maintenance machine 10 by pulling down the pull-pin handles 32*a*, aligning the second attaching portion flange 30 with the steering column flange 18*a*, and releasing the pull-pin handles 32*a*.

Upon releasing a handle 32*a* the pull-pin shaft 32*c* is also released. The pull-pin shaft 32*c* then extends through the second attaching portion holes 31 and the corresponding steering column flange holes. This provides the connection between the second attaching portion 29 and the steering column 13 and also provides visual indication that the sulky 20 and floor maintenance machine 10 are connected. Preferably, the flange 18*a* on bracket 18 is flared on the end to allow the pull-pin shaft 32*c* to be depressed when the sulky 20 is rotated up under the bracket 18. This allows the pull-pin shaft 32*c* to engage its corresponding hole in the flange 18*a* without the operator having to pull down the pull-pin handles 32*a*.

FIG. 4 shows the second attaching portion 29 of the sulky 20 having been selectively connected to the steering column 13 of the floor maintenance machine 10. The operator can thus proceed to steer the floor maintenance machine 10 while walking behind it without having to disconnect the sulky 20 from the floor maintenance machine 10. Additionally, as shown in FIG. 4, the standing platform 24 can have a first surface 24*a* configured so that when the second attaching portion 29 is connected to the steering column 13 the first surface 24*a* is located directly adjacent to the steering column 13. In another embodiment, where the first surface 24*a* has two guard members 24*d*, the standing portion 24*c* can be directly adjacent to the steering column 13 while the steering column 13 is positioned between the two guard members 24*d*.

In some circumstances, it may be desirable to prevent the floor maintenance machine 10 from moving in a reverse direction when the sulky 20 is attached. Thus, in an embodiment, the floor maintenance machine 10 may be provided with a reverse lockout system. The reverse lockout system prevents the floor maintenance machine 10 from moving in a reverse direction. As shown in FIG. 2, the reverse lockout system includes a reverse lockout release button 35 protruding from the steering column 13 of the floor maintenance machine 10.

In a first mode of operation, the sulky 20 is attached to the floor maintenance machine 10 with only its first attaching portion 21. In this case, the reverse lockout system prevents the floor maintenance apparatus from moving in a reverse direction.

However, the operator can disengage the reverse lockout system by pressing down the reverse lockout release button 35. In this second mode of operation, the operator selectively attaches the second attaching portion 29 of the sulky 20 to the floor maintenance steering column 13. This causes the first surface 24*a* of the standing platform 24 to contact and press down the release button 35 thus disengaging the reverse lockout system. The floor maintenance apparatus can then be driven in both a forward and a reverse direction.

In accordance with the provisions of the patent statutes, the present invention has been disclosed in what are considered to represent its preferred embodiments. However, it should be noted that the invention can be practiced otherwise than as specifically illustrated and described without departing from its spirit or scope.

What is claimed is:

1. A floor maintenance apparatus, comprising:

a floor maintenance machine having a steering column, at least two rear wheels, and a swivel attached to said floor maintenance machine, said swivel positioned between said rear wheels and having a vertical axis of rotation;

a sulky positioned behind said floor maintenance machine, comprising a first attaching portion, a stopping portion, a wheel receiving portion, and a standing platform wherein said platform comprises a first portion and a second portion wherein at least one wheel is rotatably mounted to said first portion; and a removable attaching means connecting said first attaching portion of said sulky to said swivel of said floor maintenance machine, wherein said attaching means permits said sulky to rotate about a horizontal axis.

2. The apparatus according to claim 1, wherein said floor maintenance machine is a burnisher.

3. The apparatus of claim 1, wherein a stop is attached to said floor maintenance machine between said rear wheels and in-line and forward of said swivel.

4. The apparatus of claim 3, wherein said sulky has a second attaching portion located on said second portion of said standing platform for selectively connecting said platform to said steering column of said floor maintenance machine.

5. The apparatus of claim 4, wherein said standing platform has a first surface complimentary with said steering column, said first surface comprising a standing portion and at least one guard member, said guard member comprising at least one raised member located on the periphery of said standing portion.

6. The apparatus of claim 3, wherein said stop comprises a post.

7. The apparatus of claim 3, wherein a first frame member rigidly supports said attaching portion, said stopping portion, said wheel receiving portion, and said standing platform of said sulky.

8. The apparatus of claim 3, wherein said attaching means is a cotter pin and a clevis pin, a bolt and a nut, or a lock weight pin.

9. A method for operating a floor maintenance machine, comprising:

providing a sulky, said sulky comprising a standing platform having a first portion and a second portion wherein at least one wheel is rotatably mounted to said first portion, a wheel receiving portion attached to said platform, a stopping portion attached to said wheel receiving portion, and a first attaching portion attached to said stopping portion;

pivotally connecting said sulky to a self-propelled floor maintenance machine having at least two rear wheels and a swivel having a vertical axis of rotation, wherein said pivotal connection is made by connecting said swivel with said first attaching portion of said sulky; and contacting said stopping portion of said sulky with a stop to allow said wheel receiving portion to receive said wheels but preventing said rotation of said sulky about said vertical axis so that said floor maintenance rear wheels do not contact said wheel receiving portion.

10. The method of claim 9, further comprising upwardly biasing a rearward portion of said floor maintenance machine via the weight of an operator standing on said standing platform of said sulky.

11. A method for operating a floor maintenance machine, comprising:

providing a sulky, said sulky comprising a first attaching portion, a stopping portion, a wheel receiving portion, and a standing platform having a first portion and a second portion wherein at least one wheel is rotatably mounted to said first portion and a second attaching portion is connected to said second portion;

connecting said sulky at said first attaching portion to a swivel attached to a self-propelled floor maintenance machine so as to create a horizontal axis of rotation, said floor maintenance machine having a steering column and at least two rear wheels wherein said swivel is positioned between said rear wheels;

lifting said sulky in a vertical direction along said horizontal axis of rotation; and selectively connecting said second attaching portion of said sulky to said steering column of said floor maintenance machine.

12. The method of claim 11, further comprising providing an operator with visual indication that said second attaching portion is connected to said steering column.

13. The method of claim 11, wherein said standing platform further comprises a first surface having a standing portion and at least one guard member, said first surface configured such that when said second attaching portion is connected to said steering column said first surface is located directly adjacent to said steering column.

14. The method of claim 13, wherein said first surface has two guard members and when said second attaching portion is connected to said steering column said standing portion is directly adjacent said steering column and said steering column is positioned between said guard members.

* * * * *